US009657542B2

(12) United States Patent
Al-Mulhem

(10) Patent No.: US 9,657,542 B2
(45) Date of Patent: May 23, 2017

(54) WIRELINE CRAWLER TRACTOR

(71) Applicant: Saudi Arabian Oil Company, Dhahran (SA)

(72) Inventor: Abdulrahman Abdulaziz Al-Mulhem, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 284 days.

(21) Appl. No.: 14/069,624

(22) Filed: Nov. 1, 2013

(65) Prior Publication Data

US 2014/0116729 A1 May 1, 2014

Related U.S. Application Data

(60) Provisional application No. 61/721,393, filed on Nov. 1, 2012.

(51) Int. Cl.
*E21B 23/14* (2006.01)
*E21B 23/00* (2006.01)

(52) U.S. Cl.
CPC ..... *E21B 23/14* (2013.01); *E21B 2023/008* (2013.01)

(58) Field of Classification Search
CPC ..... E21B 23/14; E21B 2023/008; E21B 2023/008
See application file for complete search history.

(56) References Cited

U.S. PATENT DOCUMENTS

| | | | | |
|---|---|---|---|---|
| 2,776,564 | A | 1/1957 | Montgomery et al. | |
| 4,085,808 | A * | 4/1978 | Kling | E21B 4/18 175/61 |
| 4,770,105 | A * | 9/1988 | Takagi | F16L 55/30 104/138.2 |
| 2003/0173076 | A1 | 9/2003 | Sheiretov et al. | |
| 2005/0145415 | A1 | 7/2005 | Doering et al. | |
| 2005/0217867 | A1* | 10/2005 | Misselbrook | E21B 17/20 166/384 |
| 2006/0180318 | A1 | 8/2006 | Doering et al. | |

(Continued)

OTHER PUBLICATIONS

International Search Report and Written Opinion of PCT Application PCT/US2013/067940, Oct. 24, 2014.

(Continued)

*Primary Examiner* — Michael Wills, III
(74) *Attorney, Agent, or Firm* — Bracewell LLP; Constance G. Rhebergen

(57) ABSTRACT

A well tractor for use in inserting a bottom hole assembly into a wellbore, the well tractor including a tractor body, and two or more wheels connected to the tractor body by pivot arms and having a retracted position and a deployed position, the at least two wheels moveable between the retracted and deployed positions by hydraulic cylinders attached to the pivot arms. The well tractor further includes a track creating a loop around at least two wheels and engaged with the wheels, so that when the wheels rotate, the track also rotates around the wheels. When the wheels are in the retracted position, the track is maintained in close proximity to the tractor body, and when the wheels are in the deployed position, the track extends radially away from the tractor body and into contact with surfaces of the wellbore.

20 Claims, 4 Drawing Sheets

(56) References Cited

U.S. PATENT DOCUMENTS

| | | | | |
|---|---|---|---|---|
| 2008/0135292 | A1* | 6/2008 | Sihler | E21B 44/005 175/27 |
| 2008/0202769 | A1 | 8/2008 | Dupree et al. | |
| 2009/0271117 | A1 | 10/2009 | Ayoub et al. | |
| 2010/0012315 | A1 | 1/2010 | McInally | |
| 2010/0037712 | A1* | 2/2010 | Burton | E21B 7/027 73/863.11 |
| 2010/0263856 | A1* | 10/2010 | Lynde | E21B 23/14 166/53 |
| 2013/0068479 | A1 | 3/2013 | Aldossary | |

OTHER PUBLICATIONS

"How Do Well Tractors Work?" www.rigzone.com/training/insight; Rigzone.com, Inc.

* cited by examiner

WIRELINE CRAWLER TRACTOR

BACKGROUND OF THE INVENTION

1. Field of the Invention

The present technology relates to oil and gas wells. In particular, the present technology relates to a tractor tool for helping to move a bottom hole assembly through a horizontal wellbore.

2. Description of the Related Art

Oil wells are typically examined to determine petrophysical properties related to one or more of the well bore, the reservoir it penetrates, and the adjacent formation. Such an examination is typically carried out by a well logging tool, which is lowered to the bottom of the well, and employs electrical, mechanical, and/or radioactive tools to measure and record certain physical parameters. Lowering the logging tool and other equipment (collectively known as the bottom hole assembly) to the bottom of the well can be difficult, particularly in horizontal or otherwise deviated wells, where tubing is used to push the bottom hole assembly through the well bore. One reason for this difficulty is friction between the bottom hole assembly and walls of the well bore. The result of this friction can be that the bottom hole assembly stops progressing toward the bottom of the well. If the bottom hole assembly becomes stuck, the tubing that pushes the bottom hole assembly can buckle.

One known way to overcome this problem is with a well tractor that applies an urging force to the bottom hole assembly. A well tractor is a wheeled device that may be included with the bottom hole assembly. When the bottom hole assembly is pushed into the horizontal portion of the well, and if the friction between the bottom hole assembly and the well begins to slow or stop the progress of the bottom hole assembly toward the bottom of the well, the wheels on the well tractor may turn to drive the bottom hole assembly further into the well. Use of such a well tractor, however, can be problematic. For example, in reservoirs where the rock has low strength, insufficient traction may exist for the tractor to propel the bottom hole assembly toward the bottom of the hole.

SUMMARY OF THE INVENTION

One embodiment of the present technology provides a well tractor for use in inserting a bottom hole assembly into a wellbore. The well tractor includes a tractor body, and two or more wheels connected to the tractor body by pivot arms and having a retracted position and a deployed position, the two or more wheels moveable between the retracted and deployed positions by hydraulic cylinders attached to the pivot arms. The well tractor also includes a track creating a loop around two or more wheels and engaged with the wheels, so that when the wheels rotate, the track also rotates around the wheels. When the wheels are in the retracted position, the track is maintained in close proximity to the cylindrical body, and when the wheels are in the deployed position, the track extends radially away from the cylindrical body and into contact with surfaces of the wellbore.

In some embodiments, more than one track can be spaced circumferentially at intervals around the tractor body. In addition, the pivot arms can be rotatable from a position parallel to the cylindrical body, in which the wheels are in the retracted position, to a position perpendicular to the cylindrical body, in which the wheels are in a fully deployed position. The pivot arms can be biased toward a deployed position so that the tracks maintain contact with the surfaces of the wellbore. Furthermore, the wheels can be hydraulically powered, can be made of metal, and can be spaced at least about 10 inches apart.

In some embodiments, when the wheels are in the retracted position, the tracks may not extend radially beyond the outer surface of the tractor body. In addition, the wheels can be positioned at intervals around the entire circumference of the tractor body, and there can be four sets of two or more wheels are located at four positions on the tractor body, the positions phased at 90 degree intervals. Furthermore, the pivot arms can have recesses to accept the hydraulic cylinders when the wheels are in the retracted position.

Another embodiment of the present technology provides a system for inserting logging equipment into a horizontal well. The system includes a logging tool, and tubing attached to the logging tool for connecting the logging tool to the top of the well and for pushing the logging tool through the horizontal portion of the well. The system also includes a tractor tool attached to the tubing. The tractor tool can include a substantially cylindrical body, and two or more wheels connected to the substantially cylindrical body by pivot arms and having a retracted position and a deployed position, the two or more wheels moveable between the retracted and deployed positions by hydraulic cylinders attached to the pivot arms. Furthermore, the tractor tool can have a track creating a loop around at least two wheels and engaged with the wheels, so that when the wheels rotate, the track also rotates around the wheels. When the wheels are in the retracted position, the tracks are maintained in close proximity to the cylindrical body, and when the wheels are in the deployed position, the tracks extend radially away from the cylindrical body and into contact with surfaces of the wellbore.

In some embodiments, the tractor tool can include four tracks spaced circumferentially at 90 degree intervals around the circumference of the cylindrical body. When the track of the tractor tool is in a retracted position, it may not extend radially outward beyond an outer surface of the cylindrical body. In addition, the pivot arms can rotate from a position parallel to the cylindrical body, in which the wheels are in the retracted position, to a position perpendicular to the cylindrical body, in which the wheels are in a fully deployed position. Furthermore, the pivot arms of the tractor tool can be biased toward a deployed position so that the tracks maintain contact with the surfaces of the wellbore, and the wheels of the tractor tool can be spaced at least about 10 inches apart. The pivot arms of the tractor tool can have recesses for accepting the hydraulic cylinders when in the retracted position.

Yet another embodiment of the present technology provides a method of inserting logging equipment into a wellbore. The method includes the steps of inserting a bottom hole assembly attached to coiled tubing into a wellbore, the bottom hole assembly including a tractor tool having a tractor body with a track attached thereto, and retracting the track into the tractor body so that the track does not extend outside the tractor body. The method further includes the steps of lowering the bottom hole assembly through a vertical part of the well, and pushing the bottom hole assembly through a horizontal part of the well using the tubing. In addition, the method includes deploying the track from the tractor body using a hydraulic cylinder attached to the track until the track contacts a surface of the well, and driving the bottom hole assembly in a horizontal portion of the well by rotating the track against the surface of the wellbore to overcome friction between the bottom hole assembly and the wellbore. In some embodiments, the method can include biasing the track so that when it is deployed it maintains constant contact with the surface of the wellbore.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION OF THE EXEMPLARY EMBODIMENTS

Figure 1:
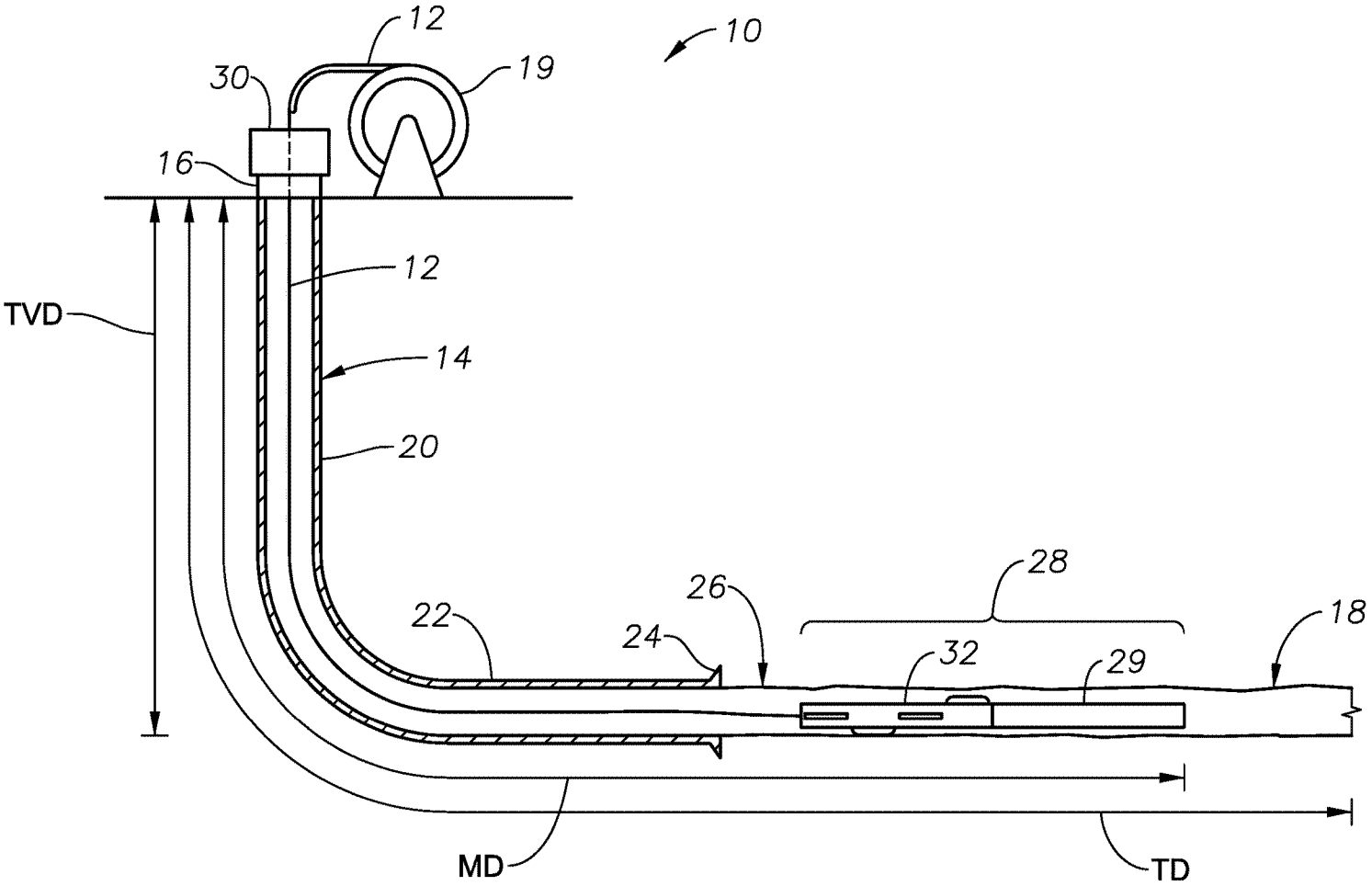
FIG. 1 is a schematic side view of a bottom hole assembly with a well tractor, inserted in a well bore.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, the embodiments are not intended to be limited to the specific terms used, and it is to be understood that each specific term includes equivalents that operate in a similar manner to accomplish a similar purpose.

FIG. 1 shows a schematic view of an example of a well logging assembly 10. The well logging assembly 10 includes tubing 12 that extends through a well 14 from a wellhead 16 toward a bottom of the well 18. Prior to entry into the well 14, the tubing 12 is coiled around a coiled tubing reel 19. The well 14 can include a vertical section 20 and a horizontal or deviated section 22. The length of the vertical section 20 of the well 14 is known as the true vertical depth TVD, and the length of the well 14 from the wellhead 16 to the bottom of the well 18 is known as the total well depth TD. The web 14 is lined with a casing (not shown) that extends along a substantial portion of the wellbore from the wellhead downward, terminating at a casing shoe 24. Below the casing shoe 24 is an open hole section 26 of the well 14.

There is attached to the end of the tubing 12 a bottom hole assembly 28, which, in the embodiment shown in FIG. 1, includes a logging tool 29 and a well tractor 32. The logging tool 29 can include mechanical, electrical, and/or radioactive equipment to record physical measurements that are then interpreted to provide a description of the petrophysical properties of the wellbore, the reservoir, and/or the formation. The length of the well 14 from the wellhead 16 to the bottom hole assembly 28 is known as the measured depth MD.

As the tubing 12 is unwound from the coiled tubing reel 19, the bottom hole assembly 28 is lowered into the well 14. In the vertical portion 20 of the well 14, the weight of the bottom hole assembly 28 pulls the bottom hole assembly 28 and its attached tubing 12 into the well 14. In wells having no horizontal or deviated portion, the weight of the bottom hole assembly 28 alone may be sufficient to bring the bottom hole assembly 28 to the bottom 18 of the well 14. However, in wells having a horizontal or deviated portion 22, the coiled tubing 12 can push the bottom hole assembly 28 further into the well 14 to move the bottom hole assembly 28 through the horizontal or deviated portion 22 of the well 14. Optionally, an injector 30 forces the tubing 12 into the well once the bottom hole assembly 28 reaches the horizontal or deviated portion 22 of the well 14.

As the bottom hole assembly 28 and the end of the tube 12 progress through the horizontal or deviated portion 22 of the well 14, friction can develop between the bottom hole assembly 28 and walls of the well 14. As friction between these components increases, the injector 30 must exert more and more force on the tubing 12 to continue pushing the bottom hole assembly 28 deeper into the well 14. If the frictional forces between the bottom hole assembly 28 and the walls of the well 14 become greater than the force exerted on the tubing by the injector 30, forward progress of the bottom hole assembly 28 into the well 14 can slow or stop. In this situation, the bottom hole assembly 28, including the logging tool 29, cannot reach the bottom of the well 18 to record the required measurements. In addition, such a situation can lead to the tubing 12 buckling as the bottom hole assembly 28 stops progressing at the same rate as the tubing 12.

To overcome the problem of buckled tubing 12, and to help the bottom hole assembly 28 progress down the well 14, the well tractor 32 can be useful. The well tractor 32 attaches to the logging tool and the tubing, and has wheels that can engage the sidewalls of the well 14. The wheels can be powered by, for example, hydraulics. As the wheels of the well tractor 32 turn, the well tractor 32 can push (or pull) the rest of the bottom hole assembly 28 further downhole. Known well tractors typically employ individual wheels, that turn against the inside surfaces of the well 14. These individual wheels can help to propel the tractor 32 through the well 14 under the right conditions, such as, for example, when the tractor is in the cased part of the well and the wheels contact the casing, or when the reservoir rock in the open hole section 26 has a high strength. However, where the reservoir rock in the open hole section 26 has low strength, friction reduces between the wheels of known well tractors 32 and the well surfaces, thereby causing the wheels to slip, and the well tractor 32 to lose the ability to progress through the well 14.

Figure 2:
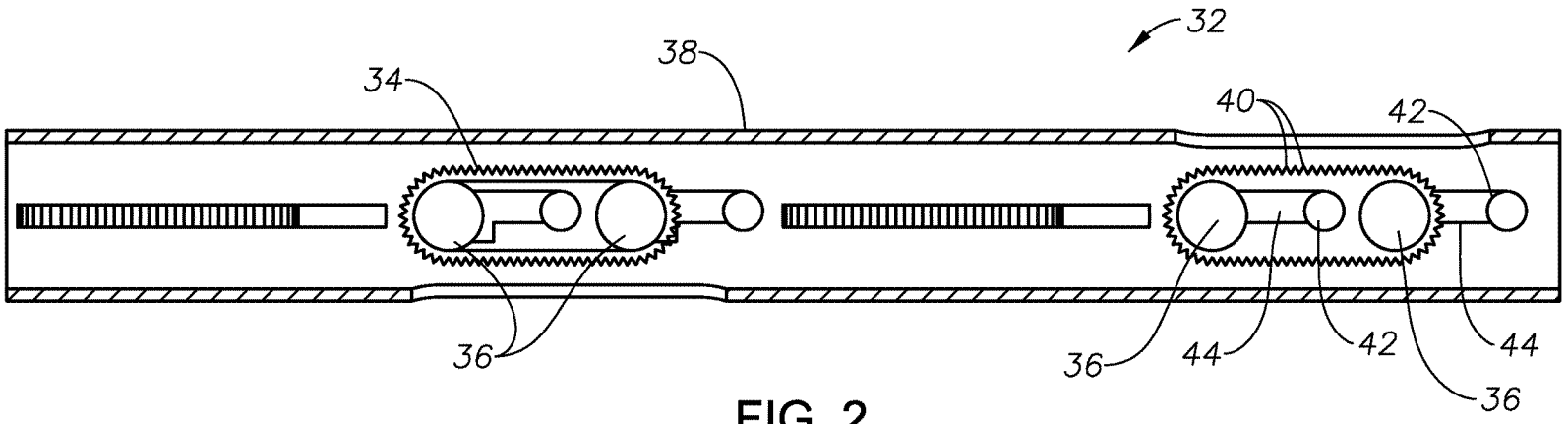
FIG. 2 is a side schematic view of the well tractor of FIG. 1, with tracks in a retracted position.
Figure 3:
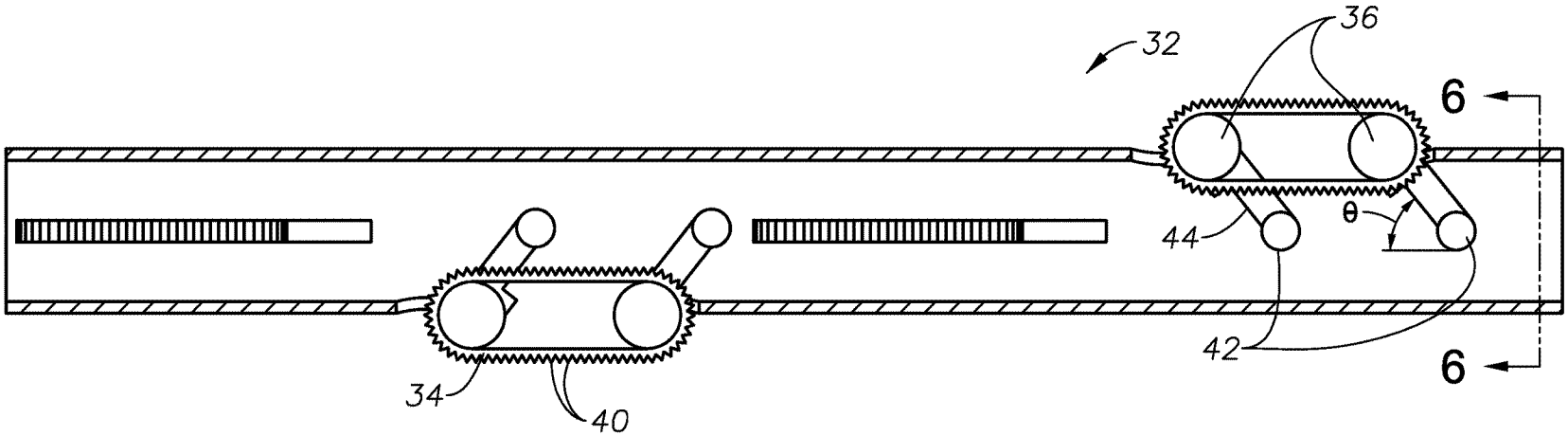
FIG. 3 is a side schematic view of the well tractor of FIG. 1, with tracks in a partially deployed position.
Figure 4:
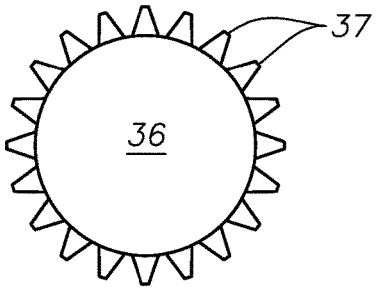
FIG. 4 is a side view of a wheel of the well tractor of FIGS. 2 and 3.

Referring now to FIGS. 2 and 3, there is shown an embodiment of the well tractor 32 having tracks 34. In certain embodiments, the tracks can be similar to caterpillar tracks, such as those used in other applications, such as with bulldozers, tanks, and other tracked vehicles. Each track 34 may surround two or more wheels 36 and be operatively engaged with the wheels 36 so that as the wheels 36 turn, the track 34 also turns. As shown in FIG. 4, the wheels 36 can have teeth 37 extending radially outwardly therefrom. The teeth 37 can be configured to engage corresponding recesses or apertures (not shown) in the tracks 34, so that as the wheels 36 turn, the tracks 34 move. The tracks 34 can be made of steel or other metal to increase their durability. In some embodiments, the tracks 34 surround two wheels 36, which wheels 36 are spaced about 10 inches apart. Of course, each track 34 can alternately surround more than two wheels 36, and the wheels 36 can be spaced more than 10 inches apart.

In FIG. 2, the tracks 34 are shown in a retracted position relative to the body 38 of the well tractor 32. In the embodiment shown, the body 38 is cylindrical. With the tracks 34 retracted, the radial profile of the well tractor 32 is reduced. In fact, in certain embodiments, the tracks 34 retract into recesses (not shown) in the body 38 so that they do not extend radially beyond the outer surface of the body 38. Accordingly, the well tractor 32 can more easily pass through the vertical portion 20 and into the horizontal or deviated portion 22 of the well 14. If desired, the tracks 34 may remain in a retracted position relative to the body 38 of the well tractor 32 until the friction between the bottom hole assembly 28 and watts of the well 14 becomes great enough that the tubing 12 can no longer push the bottom hole assembly 28 through the well 14. Thereafter, the tracks 34 can pivot into a deployed position, such as that shown in FIGS. 3 and 4.

In FIG. 3, the tracks 34 are shown in a deployed position, in which the tracks 34 are extended away from the body 38 of the well tractor 32. In the deployed position, the tracks 34 are able to contact the inner surfaces of the well 14. The increased surface area of the tracks 34, as opposed to the wheels of known well tractors, increases the amount of friction between the tracks 34 and the well 14. In addition, friction may be even further increased by optional ridges 40 on the tracks. This increased friction increases the ability of the well tractor 34 to push the bottom hole assembly 28 through the well, even when the reservoir rock that makes up the inner surfaces of the well 14 is of low strength.

Figure 6:
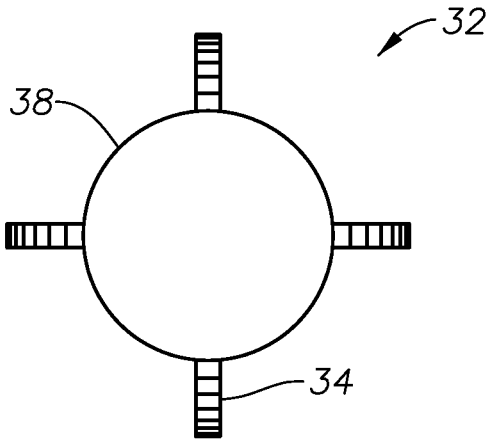
FIG. 6 is a cross-sectional view of a well tractor taken along line 6-6 of FIG. 3.

Furthermore, and as best shown in FIG. 6, the tracks 34 can be positioned around the entire circumference of the body 38 of the well tractor 32. This configuration can be advantageous because it allows the tracks to grip the well surface all around the well tractor 32. Thus, for example, if a bottom side of the well lacks strength, but the top and/or lateral sides are strong, the well tractor 32 can still progress down the well 14 because the tracks contacting the top and/or lateral sides can grip the surfaces of the well. In the specific embodiment shown in FIG. 4, the tracks 34 are positioned at 4 points around the body 38 of the well tractor 32, and are phased at 90 degrees from one another. Of course, any number of tracks 34 can be positioned around the well tractor 32 with the tracks 34 spaced any distance apart.

Figure 5:
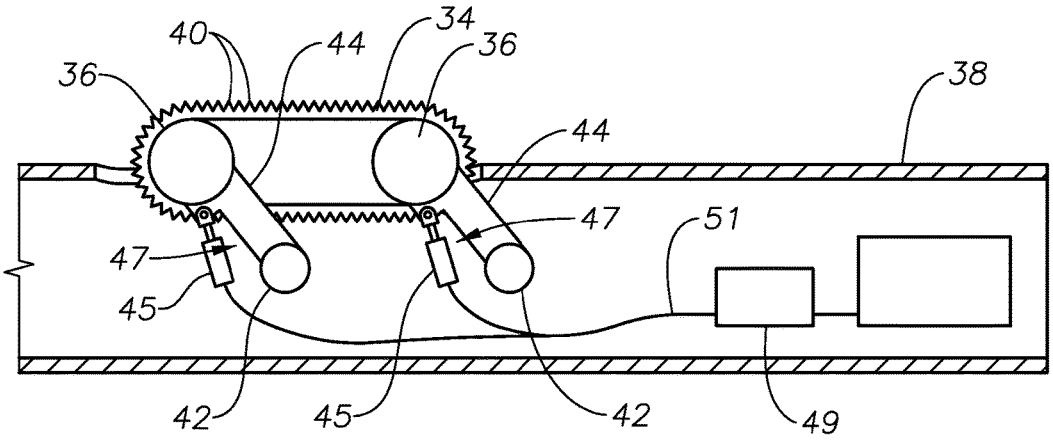
FIG. 5 is a side schematic view of a track and a pair of wheels according to an embodiment of the present technology.

Also shown in FIGS. 2 and 3 are pivots 42 and pivot arms 44. The pivot arms 44 connect the wheels 36 to the pivots 42. In some embodiments, such as that shown in FIG. 5, the pivot arms 44 can be connected to a hydraulic piston 45, which can in turn be connected to the body 38 of the well tractor 32. In the embodiment shown, each wheel 36 can be connected to a separate pivot arm 44, and each pivot arm 44 can be connected to a separate hydraulic piston 45. The pivot arms 44 can include recesses 47 to accommodate the hydraulic pistons 45 when the pivot arms 44 are in a fully retracted position.

Each hydraulic piston 45 can be powered by a hydraulic pump 49, which is connected to the hydraulic pistons 45 via hydraulic lines 51. The hydraulic pump 49 can be connected to, and receive hydraulic fluid from, for example, a hydraulic fluid reservoir 53. The hydraulic pump 49 can also be used to power the wheels that drive the tracks 34. The hydraulic pistons 45 can be controlled by an operator to move the pivot arms 44 between a retracted and a deployed state. The operator can control the hydraulic pistons 45 by activating and controlling the hydraulic pump 49 or pumps that drive the hydraulic pistons 45. In some embodiments, each hydraulic piston can be individually controllable, and can be connected to separate hydraulic pumps 49. When the well tractor 32 is not active, a coiled spring (not shown) can be used to pull the pivot arms 44 inward toward the body 38 of the well tractor 32 to a retracted state.

In addition, and as shown in FIG. 3, the pivot arms 44 are capable of rotating any radial distance θ around the pivots 42, thereby controlling how far the tracks 34 deploy from the body 38. For example, when the tracks 34 are fully retracted, the pivot arms 44 lie parallel to the body 38, as shown in FIG. 2. In such a position, the relative radial position of the pivot arms 44 is zero degrees. Conversely, when the tracks 34 are partially deployed, the pivot arms 44 are positioned at some angle θ relative to the body 38, as shown in FIG. 3. In a fully deployed position (not shown), the pivot arms 44 would be positioned perpendicular to the body 38, at ninety degrees. A biasing mechanism, such as, for example, the hydraulic pistons discussed above, or a spring, can exert a radial force on the pivot arms 44 that pushes the tracks 34 into constant contact with the inside surface of the well 14. This ability of the pivot arms 44 to move between different radial positions relative to the body 38 is beneficial, because it allows the tracks 34 to change positions relative to the body 38, depending on the shape of the well 14. Thus, regardless of whether the well 14 has a relatively large or small diameter at any given location, the tracks 34 can pivot to maintain constant contact with the surfaces of the well 14 as the well tractor 32 moves through the well.

FIG. 6 shows a cross sectional axial view of a well tractor 32 according to one embodiment of the present technology, and taken along line 6-6 of FIG. 3. In FIG. 6, the tracks 34 are shown partially deployed from the body 38 of the well tractor 32. In addition, the tracks 34 are shown spaced circumferentially around the body 38 of the well tractor 32. Thus spaced, the tracks 34 deploy in more than one direction from the body 38, and can engage different surfaces of the well 14. As discussed above, although in FIG. 6 the tracks 34 are shown to be evenly spaced around the body 38, alternate embodiments can provide tracks 34 spaced in alternate configurations. In addition, there may be any number of tracks 34 attached to the body 38.

Figure 7:
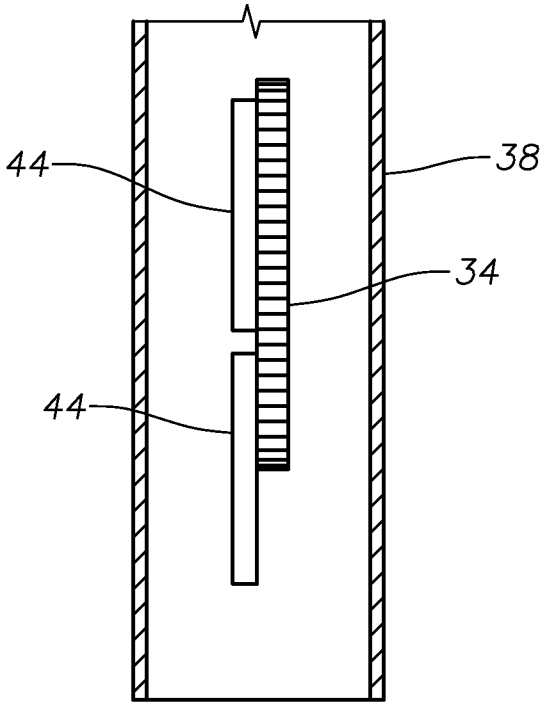
FIG. 7 is a top view of a track and pivot arms according to an embodiment of the present technology.

Referring to FIG. 7, there is shown a top view of a track 34 and pivot arms 44, according to one embodiment. As can be seen, pivot arms 44 can be positioned laterally adjacent to the track 34. In this arrangement, the pivot arms 44 can rotate to deploy or retract the tracks 34 without interfering with the movement of the tracks 34. This feature may be advantageous because it allows movement of the tracks 34, and corresponding movement of the well tractor 32, forward or backward, even as the pivot arms 44 deploy or retract the tracks 34 away from or toward the well tractor 32 according to the contours of the well.

In practice, the well tractor 32 of the present technology can be used according to the following method. Initially, the well tractor 32 can be lowered into the well 14 as part of the bottom hole assembly 28. During this step, the tracks 34 and wheels 36 of the well tractor 32 can be in a retracted position, such as that shown in FIG. 2. In the retracted position, contact between the tracks 34 and the surfaces of the well 14 is minimized or eliminated, thereby improving the ability of the well tractor 32 to pass through the vertical section 20 of the well 14. As the bottom hole assembly 28 passes through the vertical section 20 of the well 14, the weight of the bottom hole assembly 28 itself can pull the bottom hole assembly 28 downward toward the bottom 18 of the well 14. Upon reaching the horizontal section 22 of the well 114, the tubing 12 attached to the bottom hole assembly 28 can begin pushing the bottom hole assembly 28 horizontally through the well 14. If desired, such as when the frictional forces between the bottom hole assembly 28 and the well 14 exceeds the force exerted on the bottom hole assembly 28 by the tubing 12, the tracks 34 of the well tractor 32 can be deployed and allowed to contact the surfaces of the well 14. Thus deployed, the tracks 34 can turn, as described above, thereby adding an additional forward propelling force to help overcome the frictional forces between the bottom hole assembly 28 and the well 14. Thus, the well tractor 32 can help push the bottom hole assembly 28 toward the bottom 18 of the well 14.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

What is claimed is:

1. A well tractor for use in inserting a bottom hole assembly into a wellbore, the well tractor comprising:

a tractor body;

two or more wheels, each of the two or more wheels separately connected to the tractor body by at least one separate pivot arm and having a retracted position and a deployed position, each of the two or more wheels individually moveable between the retracted and deployed positions by a separate hydraulic cylinder attached to each of the pivot arms; and a track creating a loop around two or more wheels and engaged with the wheels, so that when the wheels rotate, the track also rotates around the wheels;

wherein when the wheels are in the retracted position, the track is maintained in close proximity to the tractor body, and when the wheels are in the deployed position, the track extends radially away from the tractor body and into contact with surfaces of the wellbore.

2. The well tractor of claim 1, comprising more than one track spaced circumferentially at intervals around the tractor body.

3. The well tractor of claim 1, wherein the pivot arms are rotatable from a position parallel to the tractor body, in which the wheels are in the retracted position, to a position perpendicular to the tractor body, in which the wheels are in a fully deployed position.

4. The well tractor of claim 3, wherein the pivot arms are biased toward a deployed position so that the tracks maintain contact with the surfaces of the wellbore.

5. The well tractor of claim 1, wherein the wheels are hydraulically powered.

6. The well tractor of claim 1, wherein the track is made of metal.

7. The well tractor of claim 1, wherein the wheels are spaced at least about 10 inches apart.

8. The well tractor of claim 1, wherein when the wheels are in the retracted position, the tracks do not extend radially beyond the outer surface of the tractor body.

9. The well tractor of claim 1, wherein the wheels are positioned at intervals around the entire circumference of the tractor body.

10. The well tractor of claim 1, wherein four sets of two or more wheels are located at four positions on the tractor body, the positions phased at 90 degree intervals.

11. The well tractor of claim 1, wherein the pivot arms have recesses to accept the hydraulic cylinders when the wheels are in the retracted position.

12. A system for inserting logging equipment into a horizontal well, the system comprising:

a logging tool;

tubing attached to the logging tool for connecting the logging tool to the top of the well and for pushing the logging tool through the horizontal portion of the well; and a tractor tool attached to the tubing, the tractor tool comprising:

a substantially cylindrical body;

two or more wheels, each of two or more wheels separately connected to the substantially cylindrical body by at least one separate pivot arm and having a retracted position and a deployed position, each of the two or more wheels individually moveable between the retracted and deployed positions by a separate hydraulic cylinder attached to each of the pivot arms; and a track creating a loop around at least two wheels and engaged with the wheels, so that when the wheels rotate, the track also rotates around the wheels;

wherein when the wheels are in the retracted position, the tracks are maintained in close proximity to the cylindrical body, and when the wheels are in the deployed position, the tracks extend radially away from the cylindrical body and into contact with surfaces of the well.

13. The system of claim 12, wherein the tractor tool comprises four tracks spaced circumferentially at 90 degree intervals around the circumference of the cylindrical body.

14. The system of claim 12, wherein when the track of the tractor tool is in a retracted position it does not extend radially outward beyond an outer surface of the cylindrical body.

15. The system of claim 12, wherein the pivot arms rotatable from a position parallel to the cylindrical body, in which the wheels are in the retracted position, to a position perpendicular to the cylindrical body, in which the wheels are in a fully deployed position.

16. The system of claim 15, wherein the pivot arms of the tractor tool are biased toward a deployed position so that the tracks maintain contact with the surfaces of the well.

17. The system of claim 12, wherein the wheels of the tractor tool are spaced at least about 10 inches apart.

18. The system of claim 12, wherein the pivot arms of the tractor tool have recesses for accepting the hydraulic cylinders when in the retracted position.

19. A method of inserting logging equipment into a well, the method comprising the steps of:

inserting a bottom hole assembly attached to coiled tubing into a well, the bottom hole assembly including a tractor tool having a tractor body with wheels, each of the wheels being separately discretely attached to the tractor body by a separate pivot arm, the wheels having a track attached thereto;

retracting the track into the tractor body so that the track does not extend outside the tractor body;

lowering the bottom hole assembly through a vertical part of the well;

pushing the bottom hole assembly through a horizontal portion of the well using the tubing; and deploying the track from the tractor body by pivoting the wheels individually away from the tractor body on the pivot arms so that each wheel pushes a corresponding portion of the track into contact with a surface of the well;

driving the bottom hole assembly in a horizontal portion of the well by rotating the track against the surface of the well to overcome friction between the bottom hole assembly and the well.

20. The method of claim 19, further comprising:

biasing the track so that when it is deployed it maintains constant contact with the surface of the well.

* * * * *